US005104489A

United States Patent [19]

Beisswanger et al.

[11] Patent Number: 5,104,489

[45] Date of Patent: * Apr. 14, 1992

[54] CYLINDER FOR THE GUIDING OF ENDLESS WEBS OF MATERIAL

[75] Inventors: Rudolf Beisswanger, Steinheim; Hans-Peter Sollinger, Heidenheim, both of Fed. Rep. of Germany

[73] Assignee: J.M. Voith GmbH, Heidenheim, Fed. Rep. of Germany

[ * ] Notice: The portion of the term of this patent subsequent to Oct. 22, 2008 has been disclaimed.

[21] Appl. No.: 701,520

[22] Filed: May 16, 1991

Related U.S. Application Data

[63] Continuation of Ser. No. 513,595, Apr. 23, 1990, Pat. No. 5,059,286.

[30] Foreign Application Priority Data

Apr. 22, 1989 [DE] Fed. Rep. of Germany ..... 3913292

[51] Int. Cl.[5] ..... D21F 3/10; D21F 1/48

[52] U.S. Cl. ..... 162/369; 29/121.1; 162/370; 226/95; 226/190

[58] Field of Search ..... 162/368-372, 162/357; 226/95, 192, 190; 29/121.1, 130

[56] References Cited

U.S. PATENT DOCUMENTS

| | | | |
|---|---|---|---|
| 3,091,563 | 5/1963 | Meyer | 126/368 |
| 3,758,378 | 9/1973 | Berger | 162/216 |
| 3,846,232 | 11/1974 | Kankaanpaa | 162/357 |
| 3,880,711 | 4/1975 | Hayes, Jr. | 162/357 |
| 4,113,557 | 9/1978 | Kankaanpaa | 162/306 |
| 4,915,791 | 4/1990 | Ranniko | 162/368 |

*Primary Examiner*—Karen M. Hastings
*Attorney, Agent, or Firm*—Baker & Daniels

[57] ABSTRACT

A hollow cylinder exhibits an internal body, which forms a sickle-shaped space by means of a partial cylindrical surface arranged eccentrically to the hollow cylinder, with a smaller radius than its internal radius. In this space there is created a vacuum on rotation of the hollow cylinder. By This means air is sucked out of the area through the boreholes of the hollow cylinder, where a web of material wraps the hollow cylinder. This leads to a firmer adherence of the web on material to the hollow cylinder.

1 Claim, 2 Drawing Sheets

CYLINDER FOR THE GUIDING OF ENDLESS WEBS OF MATERIAL

This is a continuation of application Ser. No. 07/513,595, filed Apr. 23, 1990 now U.S. Pat. No. 5,059,286.

BACKGROUND OF THE INVENTION

The invention relates to a cylinder for guiding endless webs of paper or board, especially for coating equipment or slitter/winders.

It is already known from U.S. Pat. No. 3,091,563, on suction breast rolls exhibiting a shell provided with perforations in order to carry away the water pressed into the interior of the roll, to provide an internal body which is arranged eccentrically to the hollow roll, in order to intensify removal of the pressed-out water by the generation of a vacuum in the resulting space of a sickle-shaped cross-section and in particular to prevent a rewetting. For this purpose a complete hollow cylinder was used.

In paper mills there is often a problem to conduct a web of material, in particular of paper or board, over a cylinder without losing the adherence of the web of material even at very high speeds of more than 800 m/s. When air is drawn into the up-running area of the web of material on the cylinder, a thick boundary layer is formed on the cylinder surface, which renders a firm contact of the web of material on the cylinder impossible.

SUMMARY OF THE INVENTION

It is an object of the invention to indicate a solution to this problem. The inventors have designed a hollow cylinder which exhibits in its interior an internal body which is provided with an external spiral or generally cylindrical surface, or a surface substantially corresponding to this. The surface is arranged eccentric to the shell surface of the hollow cylinder for the purpose of forming an intermediate space expanding in the cross-section in the form of a sickle. The interior body has a 5 to 30%, preferably 10 to 20%, smaller radius than the inner radius of the hollow cylinder. The shell surface of the hollow cylinder is provided throughout with boreholes at least in the area of the axial length of the internal body.

According to the invention it has been recognized that even without the boreholes of the hollow cylinder being closed off by, for example, water, the vacuum propagates towards the outside of the shell of the hollow cylinder and thus makes the boundary layer disappear.

In particular, it has furthermore been recognized that such rolls can be used for making a benchmark in the case of very long web draws, in which one or two hollow cylinders are generally driven, in order to achieve in this manner a precisely determinable web speed on the basis of the rotational speed of the hollow cylinder.

The eccentric generally cylindrical surface of the internal body is generally allocated only one sector corresponding to the area of wrap of the hollow cylinder by the web of material. At least one portion of the sickle-shaped intermediate space formed between the cylinder surface of the internal body and the hollow cylinder may be partitioned off by means of sliding plates. In this partitioned area, the openings of the hollow cylinder may be connectable by ducts that lead at least up to the axial end faces of the hollow cylinder and to a compressed air or a vacuum source. The hydraulic pipes for the hydraulic actuating cylinder of the sliding plates are capable of being easily fitted and shifted. In this way, on the one hand, the boreholes of the cylinder shell can be cleaned and, on the other, an even higher web tension can be achieved when the web starts up, by the application of vacuum.

BRIEF DESCRIPTION OF THE DRAWINGS

The invention is explained with the aid of the embodiments shown in the figures.

DETAILED DESCRIPTION OF THE PREFERRED EMBODIMENT

Figure 2:
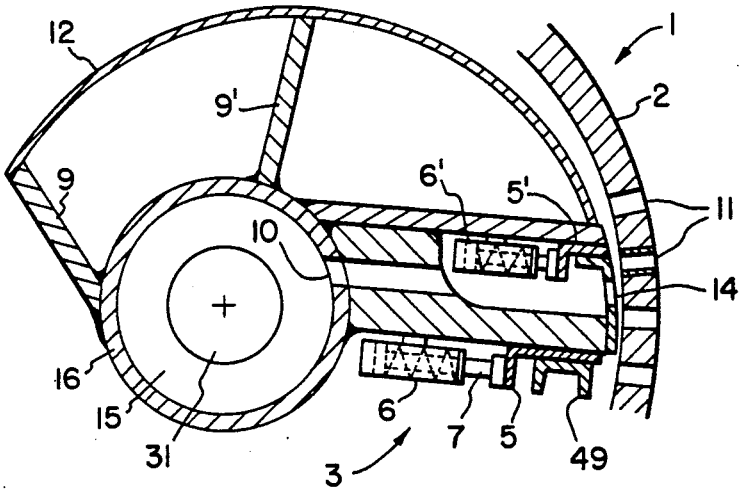
FIG. 2 illustrates a cross-section of a portion of the cylinder in FIG. 1.

The shell of the hollow cylinder 2 exhibits boreholes 11 substantially over its entire extent. An internal body 3 has a cylindrical surface 12 with a sector angle of about 120° and with a radius smaller by 5–30%, preferably 10 to 20% than the radius of the hollow cylinder 2. The cylindrical surface 12 is supported by a central hollow body 16, designed in this case as a circular hollow tube, and ribs 9, 9' or the like, welded thereto. At one point an insert piece 14 capable of being bolted on forms the cylinder shell. It closes off a hollow space in which a sliding plate 5' is disposed, which is adjustable against the shell of the cylinder 2 by means of a servomotor 6'. A further servomotor 6 is used for the same purpose, this being capable of adjusting a plate slide 5 by means of adjusting rod 7. This slide is held on the internal body 3 by means of a bar 49 having a channel-shaped cross-section.

A plurality of ducts 10 are provided, which extend up to the shell surface of the hollow cylinder 2 and continue in a central duct 31. It can be seen from FIG. 3 that sliding plates 8 are to be found at both end faces of the internal body 3 and that these plates are adjustable radially against the shell surface by means of servomotors 6. The hydraulic pipes for these servomotors are designated 41 to 44. The chamber 31 continues in radial ducts 32 and 33, which are provided in shaft butts 15 welded to the central hollow body 16. In the area of the outlet openings of these ducts there are connected bushes 25 and 27, which exhibit an internal space 26 and a connection 28 and 29 respectively for compressed air or vacuum. The internal spaces 26 are sealed off against the shaft butt by ring seals. The slides 8 are each guided in dovetail guides 48.

The hollow cylinder 2 is supported at the end faces in each case by circular supporting flanges 21 in a bearing body 23 in a ball bearing 22. The shaft butts 31 are mounted in the bearing body 36 and ball bearing 35. In this way the internal body 3 can be swivelled slightly in order to adapt its position to the area of wrap of the web of material. The hollow cylinder can be driven by a ring gear 24, which is fastened to the supporting flange 21.

Figure 1:
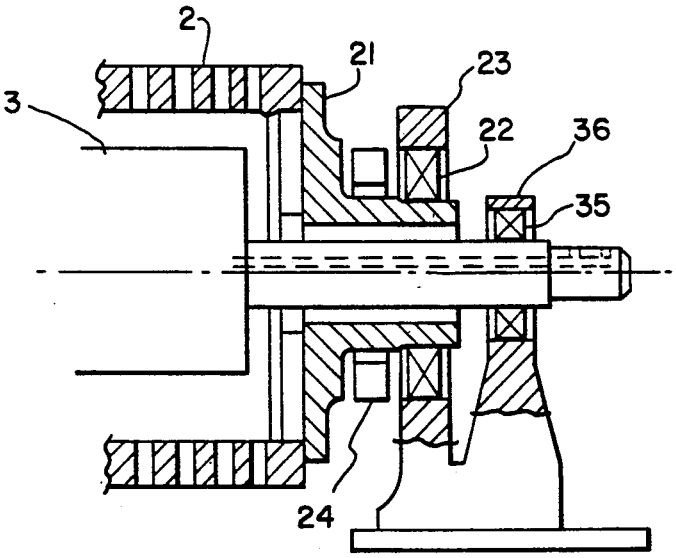
FIG. 1 illustrates a basic cross-section of the roll according to the invention.
Figure 3:
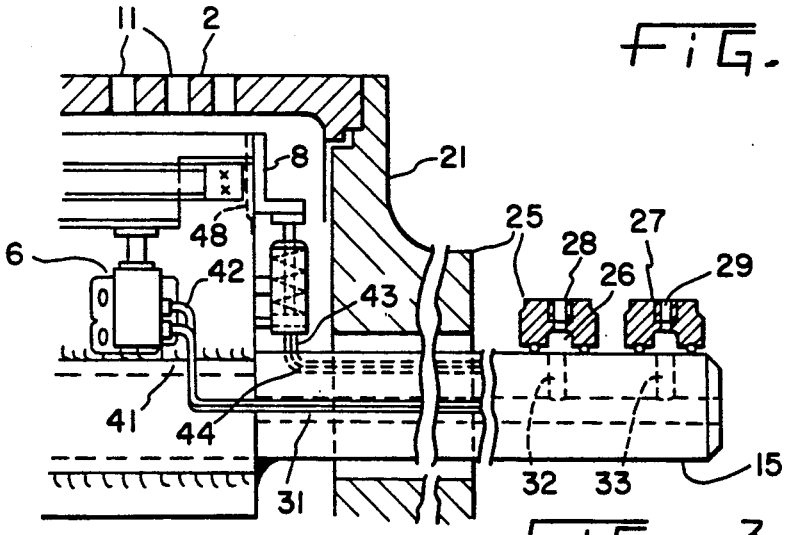
FIG. 3 illustrates a corresponding axial section on an enlarged scale.
Figure 4:
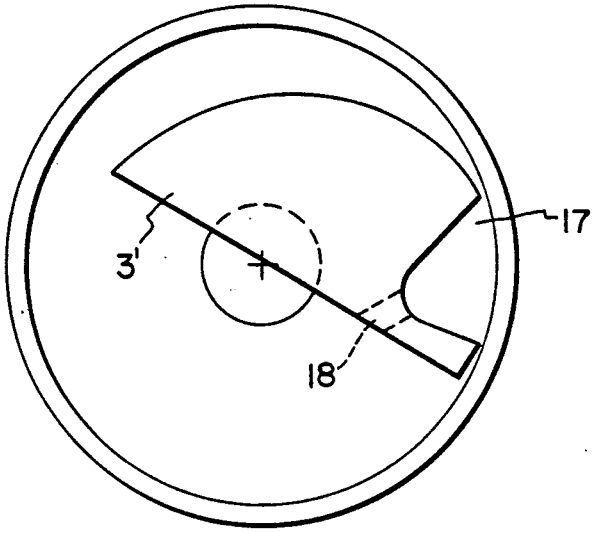
FIGS. 4–7 illustrate other embodiments of the invention basically in cross-section or partial cross-section.

According to FIG. 4, the internal body 3' ahead of the area of wrap by the web of material exhibits a duct 17, which, by means of boreholes 18 extends to the side facing away from the shell surface of the hollow cylinder 2 and are open there. By this means the entrained air can at least in part be discharged as early as at this point. This measure can therefore also be used in conjunction with the embodiment according to FIGS. 1 to 3. For this purpose it is only necessary to weld further ribs corresponding to the ribs 9, 9' to the hollow body 16 and to seal them off in the area of the hollow roll 2 by a wall in the vicinity of the shell of the hollow roll 2, as shown in FIG. 4. The boreholes would then have to be made close to the central hollow body 16.

Figure 5:
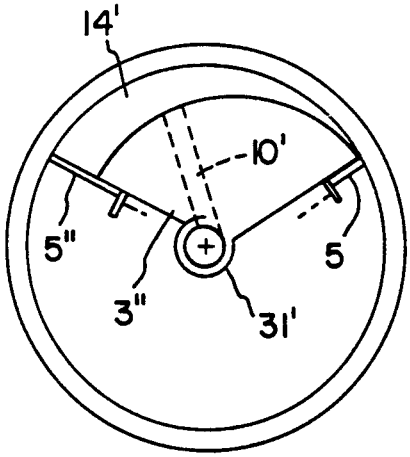

In the case of the embodiment according to FIG. 5, the sliding plates 5 and 5'' are arranged at the end faces laterally limiting the partially cylindrical peripheral surface of the internal body 3''. A duct 10', which continues in a duct 31', is provided for the supply of vacuum or compressed air. Here, therefore, the entire sickle-shaped space 14' is sealed off in the peripheral direction by the adjustable sliding plates, if necessary. But here, sealing-off as per FIGS. 2 and 3 is not readily possible at the end faces of the sickle-shaped space. Provision would have to be made here for the end faces of the internal body 3'', e.g. to be very closely adjacent to the supporting flange 21 according to FIG. 3, so that a throttling effect results here, which allows pressure build-up or pressure reduction in the sickle-shaped space 14' by connection to a source of pressure or vacuum. It would also be conceivable to have a sliding seal made of a soft, relatively easily wearing material, which permits a very small gap. A durable sealing by a sliding seal with rubber lips could also be considered.

Figure 6:
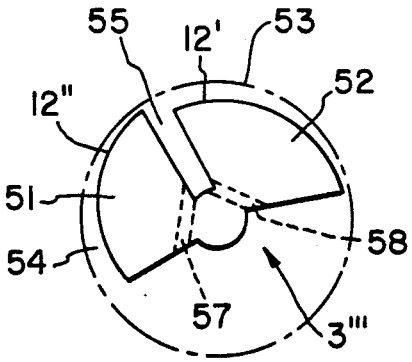

FIG. 6 shows two internal body parts 51 and 52 of an internal body 3''' provided with eccentric cylindrical partial surfaces 12' and 12''. By this means vacuum is achieved in a favorable way over a very large angle of wrap of the hollow cylinder 2. Between the internal body parts there is an intermediate space 55, which continues in ancillary ducts 57 and 58, which serve to discharge air from the first sickle-shaped space 53. Each of the first sickle-shaped space 53 and also the second space 54, can cover a peripheral area of approximately one third of the total circumference of the hollow roll 2, so that the angle of wrap for the web can in a favorable way amount to at least 120°, in which area there is a particularly good adherence of the web exists.

Figure 7:
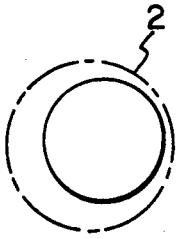

FIG. 7 shows that the hollow roll 2 can also be allocated a complete cylinder as internal body.

The surface 12 or 12' designated as cylindrical surface, which is therefore only a partial cylindrical surface in FIGS. 1 to 6, can of course also be a surface after a spiral. The internal body may naturally also be a polygonal body in order to approximate the spiral or cylindrical surface in the area of wrap by the web. In any case the important thing is to create a sickle-shaped or semi-sickle-shaped space between the internal body and the hollow roll 2.

An application of the hollow roll according to the invention is also considered for winder drums in slitter/winders and also in the case of reel spools. For application in the case of a benchmark in a web run, reference is made to the parallel German Application P 38 41 016.

While the present invention has been illustrated with the aid of specific embodiments thereof, it will be readily apparent to others skilled in the art that the invention is not limited to these particular embodiments and that various changes and modifications may be made without departing from the spirit of the invention or the scope of the appended claims.

What is claimed is:

1. A cylinder for guiding an endless web of material wherein the endless web wraps around a defined area of the circumference of the cylinder as the web is guided by the cylinder, comprising:

a rotatable hollow outer cylinder, said hollow outer cylinder having an inner radius and having an outer shell surface, said outer shell surface having boreholes therethrough, an internal body disposed interiorly of said hollow cylinder and having an inner radius, said internal body comprising two stationary internal body members disposed interiorly of said hollow cylinder, said internal body members having respective exterior surfaces wherein only a portion of each said exterior surface is spiral or generally cylindrical, said spiral or generally cylindrical exterior surfaces each covering a peripheral area of approximately one-third of the total circumference of the cylinder and being coordinated with said area of wrap of the web wherein said area of wrap comprises at least about 120 degrees of said cylinder circumference, said internal body members being arranged eccentric to said shell surface of the hollow cylinder whereby respective intermediate spaces each having a sickle-shaped cross section are formed between the respective exterior surfaces and the hollow outer cylinder, which spaces steadily expand in the same circumferential direction over the entire portion of said exterior surface and between which a discharge duct is provided, said internal body members having respective inner radii being 5 to 30 percent smaller than said outer cylinder inner radius, and said boreholes being situated in said shell in at least the area of axial length of said internal body members.

* * * * *